US006083010A

United States Patent [19]

Daoud

[11] Patent Number: 6,083,010

[45] Date of Patent: Jul. 4, 2000

[54] HINGE WITH INTEGRATED GROUNDING FEATURE

[75] Inventor: Bassel Hage Daoud, Parsippany, N.J.

[73] Assignee: Lucent Technologies, Inc., Murray Hill, N.J.

[21] Appl. No.: 09/107,485

[22] Filed: Jun. 30, 1998

[51] Int. Cl.[7] ..... H01R 39/00

[52] U.S. Cl. ..... 439/31

[58] Field of Search ..... 439/31

[56] References Cited

U.S. PATENT DOCUMENTS

| | | | |
|---|---|---|---|
| 3,729,603 | 4/1973 | Foltz | 439/31 |
| 3,842,386 | 10/1974 | Suska | 439/31 |
| 4,116,514 | 9/1978 | Lawrence | 439/31 |
| 4,140,357 | 2/1979 | Wolz et al. | 439/31 |
| 4,168,409 | 9/1979 | McNinch | 439/31 |
| 5,267,866 | 12/1993 | Swift et al. | 439/31 |

*Primary Examiner*—Paula Bradley
*Assistant Examiner*—Katrina Davis

[57] ABSTRACT

An electrically conductive hinge includes an electrically conductive first plate with a plurality of knuckles having openings. An electrically conductive second plate of the hinge also includes a plurality of knuckles having openings. The pluralities of knuckles are alternatively interlaced, and a hinge pin is inserted into the openings. One or more electrically conductive tabs are provided on the first hinge plate and frictionally engaged against one or more of the knuckles of the second hinge plate. Also, one or more electrically conductive tabs may be provided on the second hinge plate and frictionally engaged against one or more of the knuckles of the first hinge plate. The conductive tabs are resilient and provide good electrical conductivity between the first hinge plate and the second hinge plate. The hinge is particularly advantageous in grounding an electrically conductive cover to an electrical conductive housing.

20 Claims, 5 Drawing Sheets

HINGE WITH INTEGRATED GROUNDING FEATURE

FIELD OF THE INVENTION

This invention relates to a hinge mechanism for pivotally connecting a cover to a base of an electrical box. More particularly, the present invention relates to a hinge, which includes structural features that ensure a good electrical connection between the base and the cover.

BACKGROUND OF THE INVENTION

Electrical boxes, such as telephone line building entrance protectors, include a base having an interior space for housing electrical components. A cover is provided to close the base to prevent moisture and foreign matter from entering into the interior space of the base and contaminating the electrical components. Often, the cover is attached to a side of the base by a hinge, or a plurality of spaced hinges. The hinge allows the cover to be easily pivoted relative to the base, thus permitting access to the electrical components. The cover may include electrical components mounted thereon, such as LEDs, fuses, jumper terminals, etc. Therefore, it is desirable to ground the cover to the base to power the electrical components, as a safety measure, and/or to ensure the minimization of electrical noise.

The hinge, which connects the cover to the base, is usually constructed from an electrically conductive material, however the hinge is not an adequate electrical connection between the base and the cover. First, the hinge includes a loosely housed hinge pin. The hinge pin is loose so that the cover can be freely pivoted relate to the base. The loose mounting of the hinge pin results in poor electrical conductivity between the base and the cover. Also, the looseness of the hinge pin allows moisture and other contaminates to surround the hinge pin. The presence of contaminates causes corrosion, which further deteriorates the conductivity of the hinge.

As a solution, the background art provides a grounding cable connecting the cover to the base. A first terminal, at one end of the grounding cable, is attached to a bare metal portion of the base. A second terminal, at the other end of the grounding cable, is attached to a bare metal portion of the cover. The grounding cable is of sufficient length so that the cover may be pivoted about the hinge to access the electrical components in the interior space of the base.

The grounding cable of the background art suffers several disadvantages. First, the opening and closing of the cover causes fatigue and possibly breakage of the conductors of the grounding cable. Over time, the grounding of the cover may be lost, or become noisy. Second, the length of the grounding cable must be elongated to allow the cover to open fully. The elongated length of the grounding cable results in a loop. The loop is susceptible to being caught by a tool of a service person, or caught between an edge of the base and the cover when the cover is closed. Either circumstance can damage the conductors within the grounding cable. Also, the loop can accidentally be abutted against an electrical component within the base. Crosstalk between the grounding cable and the electrical component can occur, and the physical pressure of the grounding cable can result in an unplugging of the electrical component. Third, the grounding cable must, of course, be provided and installed. Often, by human error, a service person will simply forget to connect the grounding cable.

SUMMARY OF THE INVENTION

The hinge of the present invention overcomes one or more of the disadvantages associated with the grounding cable of the background art. The hinge of the present invention includes structural features, which automatically establish electrical conductivity between the cover and the base of the electrical box. Although the hinge is disclosed as replacing a grounding cable between a cover and a base, the hinge has useful applications in various arrangements. For example, the hinge can communicate any electrical potential level, whether constant or variable, between any two objects, which are pivotally attached to one another via the hinge.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION

Figure 1:
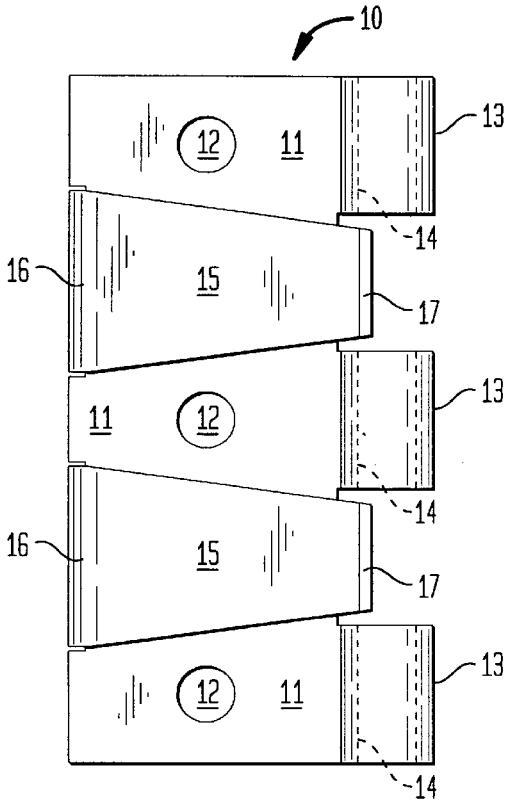
FIG. 1 is an overhead view of a first hinge plate, in accordance with a first embodiment of the present invention.
Figure 2:
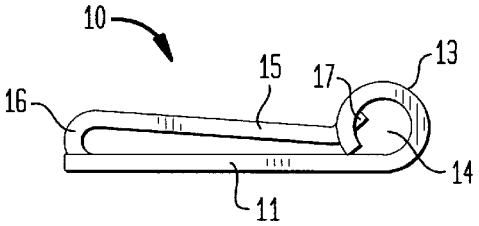
FIG. 2 is a bottom side view of the first hinge plate of FIG. 1.

FIGS. 1 and 2 illustrate a first hinge plate 10 in accordance with a first embodiment of the present invention. The first hinge plate 10 includes a substantially, flat mounting plate 11. The mounting plate 11 includes a plurality of mounting holes 12 for attaching the first hinge plate 10 to a first object, such as an electrical component housing box. When attaching the first hinge plate 10 to the first object, shaft portions of screws, bolts, nails, or rivets would pass through the mounting holes 12. Head portions of the screws, bolts, nails, or rivets would abut against the flat mounting plate 11, thereby securing the first hinge plate 10 to the first object. Although mounting holes 12 have been illustrated, it should be appreciated that other methods may be employed to attach the first hinge plate 10 to the first object such as welding, spot welding, conductive adhesives, or crimping techniques.

The first hinge plate 10 also includes a plurality of knuckles 13. Each knuckle 13 is a curled extension of the mounting plate 11. Alternately, each knuckle 13 could be a separate element, which is attached to the mounting plate 11. Each knuckle 13 curls back onto itself, in a circular cross-sectional shape, see FIG. 2. The inside portions of the knuckles 13 are open and form an aligned series of cylindrical channels 14. Although FIG. 1 illustrates three knuckles 13, it should be apparent that more or less knuckles 13 could be included, depending upon the length of the hinge. For example, it is possible for the first hinge plate 10 to include over one hundred knuckles 13.

Two electrically conductive tabs 15 are integral continuous parts of the mounting plate 11. Each conductive tab 15 has one end 16, formed as an extension of the mounting plate 11, which is curved or rolled back onto itself approximately one hundred and eighty degrees, see FIG. 2. The other ends of the conductive tabs 15 include hooks 17, which face away from the mounting plate 11. The hooks 17 are arranged between the knuckles 13 and protrude slightly into the space defined by the aligned series of cylindrical channels 14, as best seen in FIG. 2. The conductive tabs 15 are formed of a resilient material, such as spring steel, and have a natural tendency to assume the position illustrated in FIG. 2. Although the conductive tabs 15 are illustrated as being integral continuous parts of the mounting plate 11, any known fixing means could be used for attaching the conductive tabs 15 to the mounting plate 11, such as an integral forming, welds or soldering, conductive adhesives, crimping, screws, nut and bolt arrangements, rivets, clips, etc.

Figure 3:
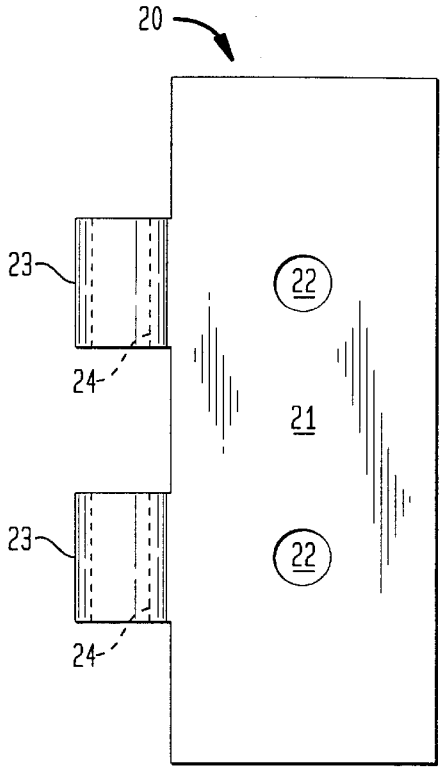
FIG. 3 is an overhead view of a second hinge plate, in accordance with the first embodiment of the present invention.
Figure 4:
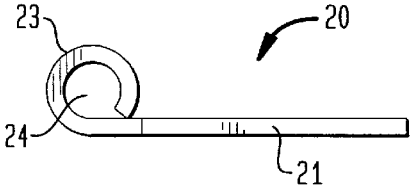
FIG. 4 is a bottom side view of the second hinge plate of FIG. 3.

FIGS. 3 and 4 illustrate a second hinge plate 20 in accordance with the first embodiment of the present invention. The second hinge plate 20 includes a substantially, flat mounting plate 21. The mounting plate 21 includes a plurality of mounting holes 22 for attaching the second hinge plate 20 to a second object, such as a cover for the electrical component housing box. The mounting plate 21 is attached to the second object using one of the techniques disclosed in relation to the mounting holes 12 of the first hinge plate 10.

The second hinge plate 20 includes a plurality of knuckles 23. Each knuckle 23 is a curled extension of the mounting plate 21, or a separate element, similar to the knuckles 13 of the first hinge plate 10. The inside portions of the knuckles 23 are open and form an aligned series of cylindrical channels 24. Although FIG. 3 illustrates two knuckles 23, it should be apparent that more or less knuckles 23 would be included depending upon the length of the hinge and number of knuckles 13 provided on the first hinge plate 10. For example, it is possible for the second hinge plate 20 to include over one hundred knuckles 23.

Figure 5:
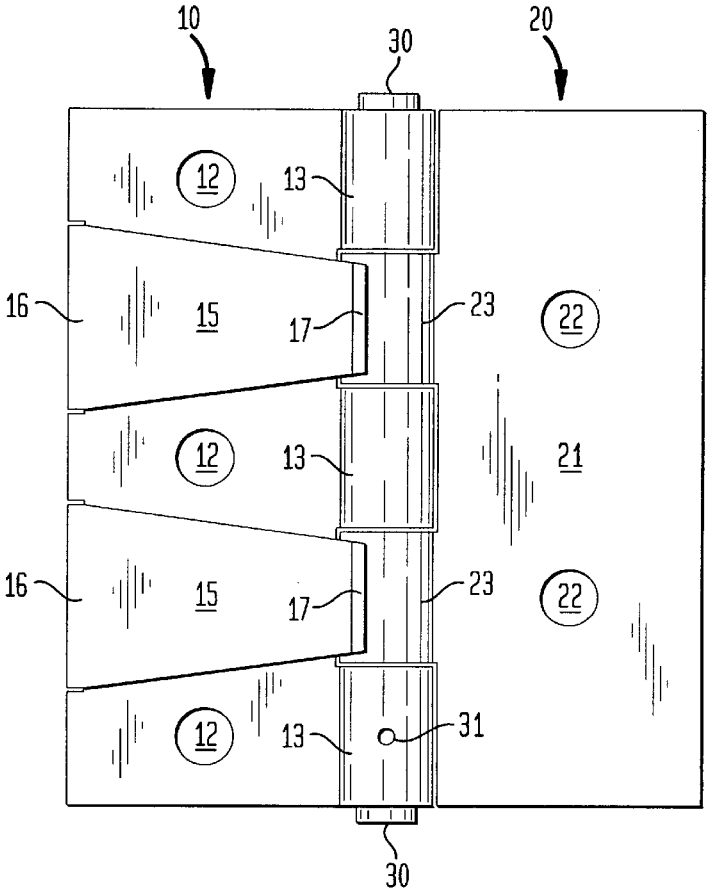
FIG. 5 is an overhead view of the first and second hinge plates of the first embodiment in an assembled, interlocked position.

FIG. 5 illustrates the first hinge plate 10 connected to the second hinge plate 20. The knuckles 13 of the first hinge plate 10 are interlaced with the knuckles 23 of the second hinge plate 20, so that the aligned series of cylindrical channels 14 are aligned with the aligned series of cylindrical channels 24. A hinge pin 30 is inserted through the two aligned sets of the openings 14, 24.

A sufficient force will be required to interlace the two sets of knuckles 13, 23. The sufficient force must overcome a biasing force caused by the resiliency of the conductive tabs 15, which tend to partially occupy the space where knuckles 23 must be inserted. While maintaining the sufficient force, the hinge pin 30 is inserted into the aligned sets of openings 14, 24. Once the hinge pin 30 is fully inserted, one or more staking indentations 31 are struck onto the knuckles 13 of the first hinge plate 10. Alternatively, one or more staking indentations could be stuck onto the knuckles 23 of the second hinge plate 20. The staking indentation 31 is used to lock the hinge pin 30 to the first hinge plate 10, or under the alternate embodiment, to the second hinge plate 20. The staking indentation 31 will prevent the hinge pin 30 from sliding out of the two aligned sets of the openings 14, 24, as the hinge is operated.

Figure 6:
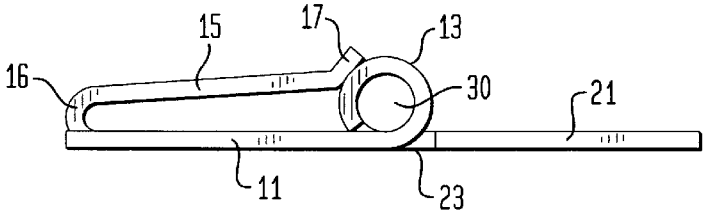
FIG. 6 is a bottom side view of the first and second hinge plates of FIG. 5.

Now, the operation of the assembled hinge will be described with reference to FIGS. 6 and 7. When assembled, the hooks 17 of the conductive tabs 15 ride on the knuckles 23 of the second hinge plate 20. The frictional engagement of the hooks 17 to the knuckles 23 is relatively tight, and provides a good electrical connection between the hooks 17 and the knuckles 23. Because the conductive tabs 15 are integral with, or attached to, the first hinge plate 10, the first hinge plate 10 will be electrically connected to the knuckles 23. Because the knuckles 23 are integral with, or attached to, the second hinge plate 20, the first hinge plate 10 will be electrically connected to the second hinge plate 20.

Figure 7:
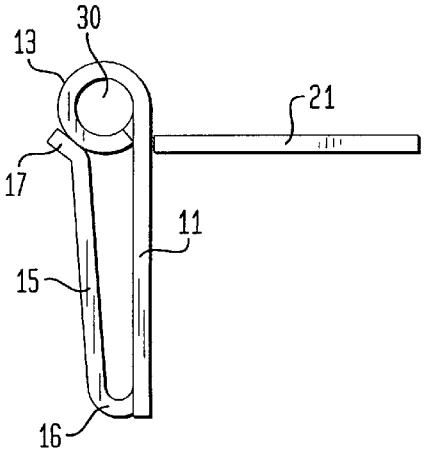
FIG. 7 is a bottom side view, similar to FIG. 6, illustrating the first hinge plate rotated ninety degrees relative to the second hinge plate.
Figure 8:
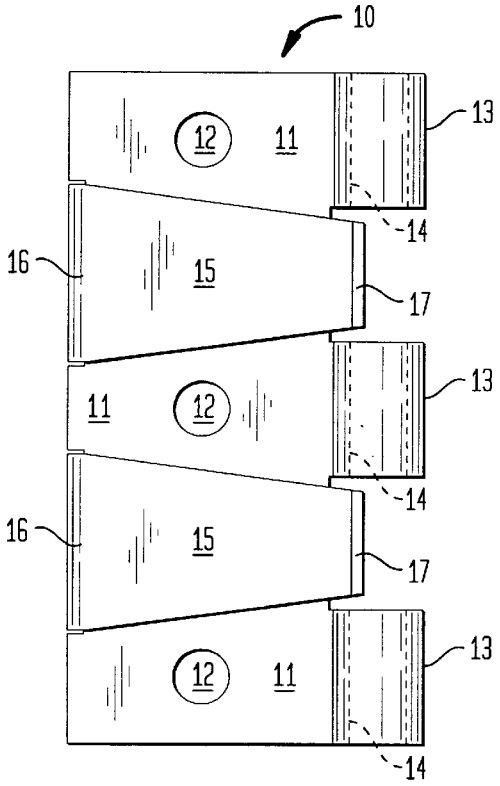
FIG. 8 is an overhead view of a first hinge plate, in accordance with a second embodiment of the present invention.
Figure 10:
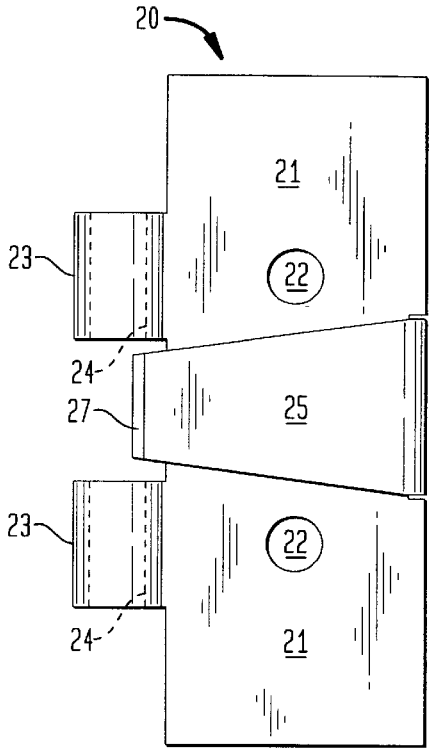
FIG. 10 is an overhead view of a second hinge plate, in accordance with the second embodiment of the present invention.
Figure 9:
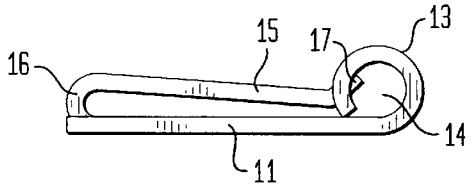
FIG. 9 is a bottom side view of the first hinge plate of FIG. 8.
Figure 11:
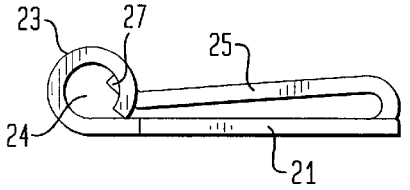
FIG. 11 is a bottom side view of the second hinge plate of FIG. 10.
Figure 12:
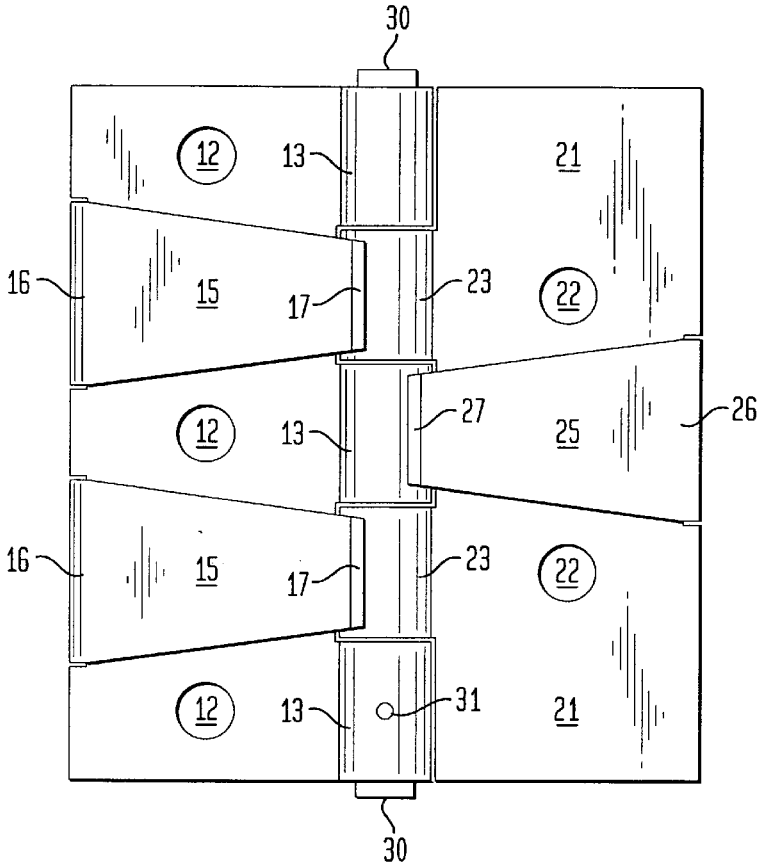
FIG. 12 is an overhead view of the first and second hinge plates of the second embodiment in an assembled, interlocked position.
Figure 13:
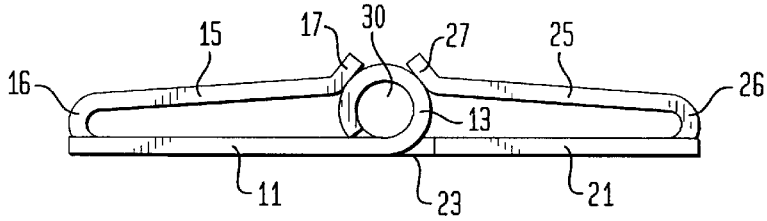
FIG. 13 is a bottom side view of the first and second hinge plates of FIG. 12.
Figure 14:
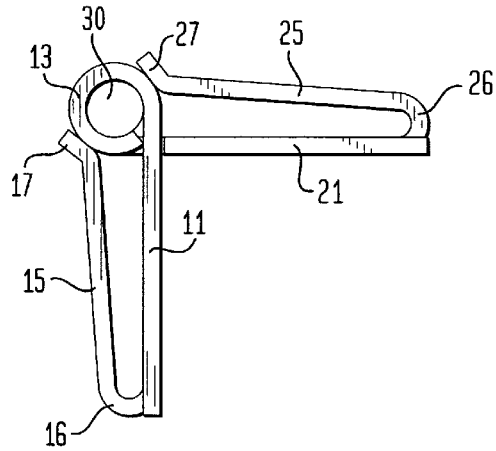
FIG. 14 is a bottom side view, similar to FIG. 13, illustrating the first hinge plate rotated ninety degrees relative to the second hinge plate.

As illustrated in FIG. 7, when the hinge is bent ninety degrees, the hooks 17 maintain good electrical contact with the knuckles 23. Therefore, the first hinge plate 10 remains in good electrical contact with the second hinge plate 20 at all times. Although two conductive tabs 15 have been illustrated, it should be understood that only one conductive tab 15 could be employed. Further, it should be understood that the hinge could include any number of knuckles. For example, the first hinge plate 10 could include twenty-five knuckles 13 and the second hinge plate 20 could include twenty-four knuckles 23. Under this circumstance, a single conductive tab 15 could be used to bear against any one of the knuckles 23 of the second hinge plate 20. Alternatively, two conductive tabs 15 could be employed on each end of the first hinge plate 10, to bear against the two knuckles on the ends of the second hinge plate 20. Alternatively, the first hinge plate 10 could include twenty-four conductive tabs 15 to bear against each of the twenty-four knuckles 23 of the second hinge plate 10.

It should be noted that the present invention is quite an improvement over the grounding cable of the background art. By the present invention, whenever the hinge is install between two electrically conductive objects, the two objects will be automatically both pivotally and electrically connected. There no longer exists a need for the additional parts of a grounding cable, connection terminals, and terminal mounting devices.

FIGS. 8–14 illustrate a second embodiment of the present invention. In the second embodiment, the second hinge plate 20 includes a conductive tab 25. The conductive tab 25 includes a curved end 26, which is connected to the second hinge plate 20 in a manner similar to the connection between the conductive tabs 15 and the first hinge plate 10. A hook 27 of the conductive tab 25 bears against a respective knuckle 13 of the first hinge plate 10. By including the conductive tab 25 on the second hinge plate 20, an even more secure electrical connection can be established between the first hinge plate 10 and the second hinge plate 20. Although one conductive tab 25 has been illustrated, it should be appreciated that several conductive tabs 25 may be provided on the second hinge plate 20 to bear against respective knuckles 13 of the first hinge plate 10.

Figure 15:
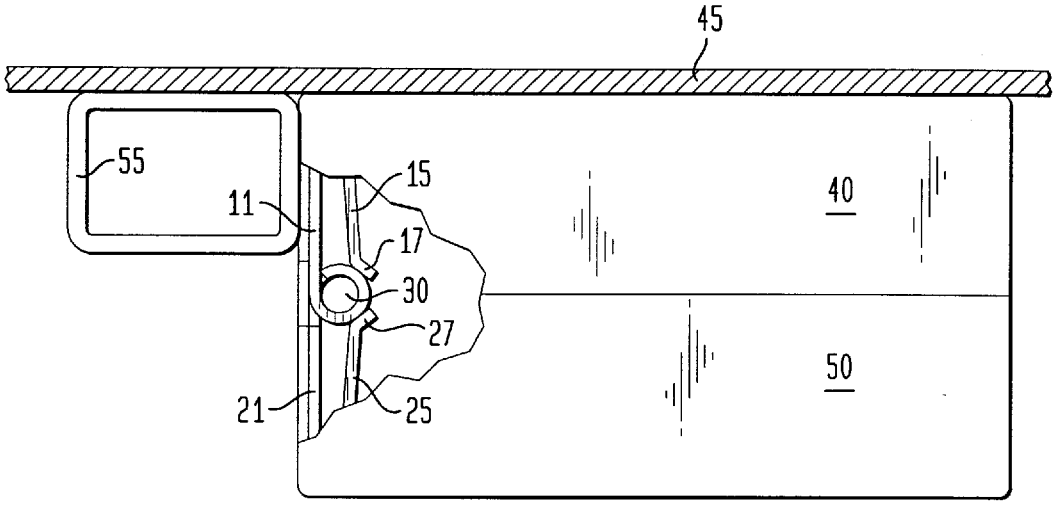
FIG. 15 depicts an electrical box having a cover attached thereto by a hinge in accordance with the second embodiment of the present invention.
Figure 16:
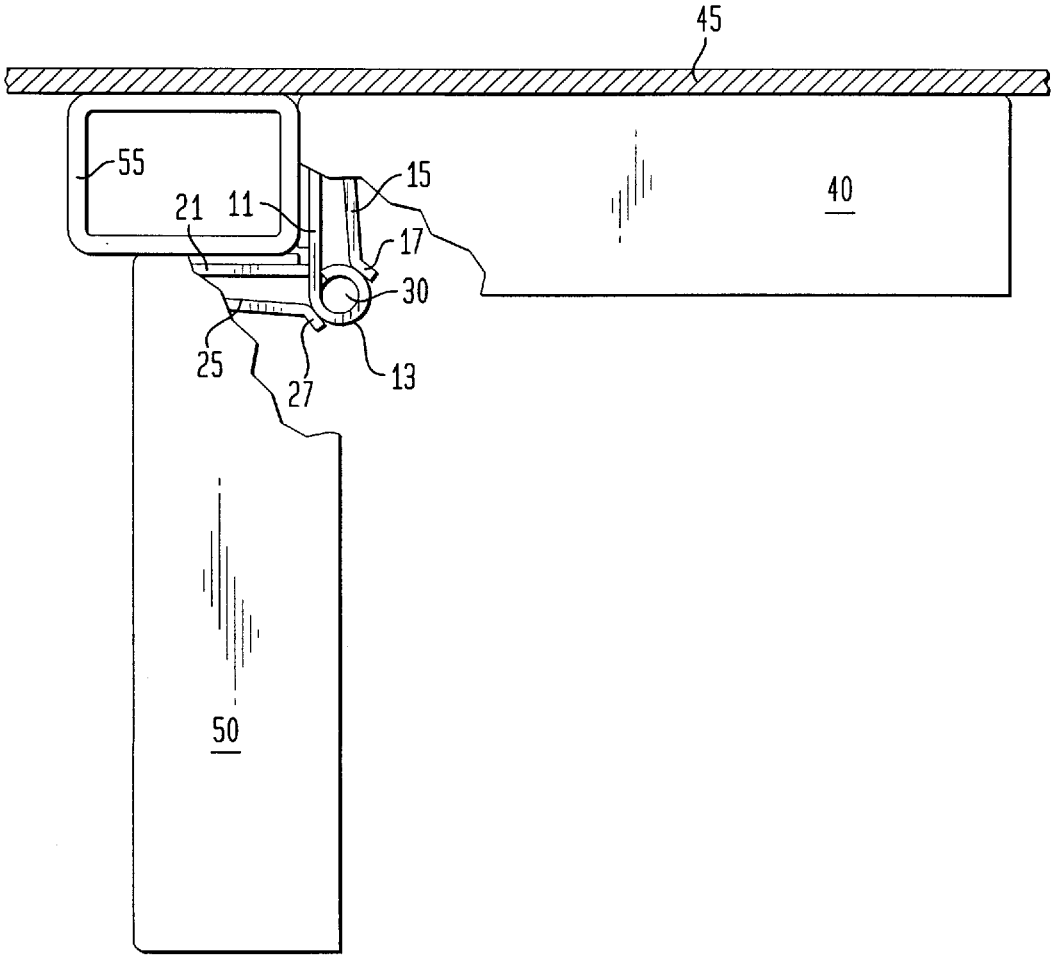
FIG. 16 depicts the electrical box of FIG. 15 having the cover in an opened position.

FIGS. 15–16 illustrate the hinge, in accordance with the second embodiment, connected to an electrical box 40 and a cover 50. The electrical box 40 is mounted to a wall 45 by suitable fastening devices, such as adhesive strips, screws, nails, rivets, clips, etc. Adjacent the electrical box 40 is a stop-strip 55. The stop-strip 55 limits the opening position of the cover 50 to approximately ninety degrees, as shown in FIG. 16.

The electrical box 40 is constructed of an electrically conductive material, such as sheet metal. The first hinge plate 10 is attached to a bare metal portion of the electrical box 40, so as to ensure good electrical conductivity between the first hinge plate 10 and the electrical box 40. The first hinge plate 10 could be attached to the electrical box 40 by welds or soldering, conductive adhesive, crimping methods, screws, nut and bolt arrangements, rivets, clips, etc.

Likewise, the cover 50 is constructed of an electrically conductive material, such as sheet metal. The second hinge plate 20 is attached to a bare metal portion of the cover 50, so as to ensure good electrical conductivity between the second hinge plate 20 and the cover 50. The second hinge plate 20 could be attached to the cover 50 by welds or soldering, conductive adhesive, crimping methods, screws, nut and bolt arrangements, rivets, clips, etc.

By the arrangement depicted in FIGS. 15 and 16, the electrical box 40 is securely, electrically connected to the cover 50 at all times. The electrical connection is most advantageously used to ground the cover 50 to the electrical box 40, however any voltage potential, whether constant or varying, could be communicated between the electrical box 40 and the cover 50 via the hinge.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrically conductive hinge for pivotally connecting a first object to a second object, said hinge comprising:

a first hinge plate;

a first knuckle attached to said first hinge plate, said first knuckle having a first opening formed therein;

a second hinge plate;

a second knuckle attached to said second hinge plate, said second knuckle having a second opening formed therein;

a pin penetrating said first opening and said second opening to pivotally connect said first hinge plate to said second hinge plate; and a first electrically conductive tab attached to said first hinge plate and frictionally engaged against said second knuckle of said second hinge plate.

2. The hinge of claim 1 wherein said first electrically conductive tab is integrally formed with said first hinge plate.

3. The hinge of claim 1 further comprising fixing means for attaching said first electrically conductive tab to said first hinge plate.

4. The hinge of claim 1 further comprising a second electrically conductive tab attached to said second hinge plate and frictionally engaged against said first knuckle of said first hinge plate.

5. The hinge of claim 1 further comprising:

a third knuckle attached to said first hinge plate, said third knuckle having a third opening formed therein;

a fourth knuckle attached to said second hinge plate, said fourth knuckle having a fourth opening formed therein;

a fifth knuckle attached to said first hinge plate, said fifth knuckle having a fifth opening formed therein, said pin penetrating said first opening, said second opening, said third opening, said fourth opening, and said fifth opening to pivotally connect said first hinge plate to said second hinge plate;

a second electrically conductive tab attached to said second hinge plate and frictionally engaged against said third knuckle of said first hinge plate; and a third electrically conductive tab attached to said first hinge plate and frictionally engaged against said fourth knuckle of said second hinge plate.

6. The hinge of claim 1 wherein said first hinge plate, said second hinge plate, and said second knuckle are constructed of an electrically conductive material.

7. The hinge of claim 1 further comprising a third knuckle attached to said first hinge plate, said third knuckle forming a third opening therein, said pin penetrating said first opening, said second opening, and said third opening to pivotally connect said first hinge plate to said second hinge plate.

8. The hinge of claim 7 further comprising:

a fourth knuckle attached to said second hinge plate, said fourth knuckle having a fourth opening formed therein;

a fifth knuckle attached to said first hinge plate, said fifth knuckle having a fifth opening formed therein, said pin penetrating said first opening, said second opening, said third opening, said fourth opening, and said fifth opening to pivotally connect said first hinge plate to said second hinge plate; and a second electrically conductive tab attached to said first hinge plate and frictionally engaged against said fourth knuckle of said second hinge plate.

9. An electrical box for housing electrical components, said electrical box comprising:

a base portion having an interior space and an opening to access said interior space; a cover for at least partially occluding said opening of said base portion; and an electrically conductive hinge including:

a first hinge plate attached to said base portion;

a first knuckle attached to said first hinge plate, said first knuckle having a first opening formed therein;

a second hinge plate attached to said cover;

a second knuckle attached to said hinge plate, said second knuckle having a second opening formed therein;

a pin penetrating said first opening and said second opening to piviotally connect said first hinge plate to said second hinge plate; and a first electrically conductive tab attached to said first hinge plate and frictionally engaged against said second knuckle of said second hinge plate.

10. The electrical box of claim 9 wherein said first electrically conductive tab is integrally formed with said first hinge plate.

11. The electrical box of claim 9 further comprising fixing means for attaching said first electrically conductive tab to said first hinge plate.

12. The electrical box of claim 9 further comprising:

a third knuckle attached to said first hinge plate, said third knuckle having a third opening formed therein;

fourth knuckle attached to said second hinge plate, said fourth knuckle having a fourth opening formed therein;

a fifth knuckle attached to said first hinge plate, said fifth knuckle having a fifth opening formed therein, said pin penetrating said first opening, said second opening, said third opening, said fourth opening, and said fifth opening to pivotally connect said first hinge plate to said second hinge plate; and a second electrically conductive tab attached to said first hinge plate and frictionally engaged against said fourth knuckle of said second hinge plate.

13. The electrical box of claim 12 wherein said base portion, said first hinge plate, said second hinge plate, said second and fourth knuckles, and said cover are constructed of an electrically conductive material.

14. The electrical box of claim 12 further comprising a third electrically conductive tab attached to said second hinge plate and frictionally engaged against said third knuckle of said first hinge plate.

15. The electrical box of claim 14 wherein said base portion, said first hinge plate, said second hinge plate, said second, third and fourth knuckles, and said cover are constructed of an electrically conductive material.

16. A method of electrically and pivotally connecting a first object to a second object, by an electrically conductive hinge the method comprising:

providing a first hinge plate with a plurality of knuckles having openings;

providing a second hinge plate with a plurality of knuckles having openings;

providing an electrically conductive tab on the first hinge plate;

alternatively, interlacing the plurality of knuckles of the first hinge plate with the plurality of knuckles of the second hinge plate;

frictionally engaging the electrically conductive tab of the first hinge plate against one of the plurality of knuckles of the second hinge plate; and inserting a hinge pin through the openings of the plurality of knuckles of the first and second hinge plates to thereby pivotally connect the first hinge plate to the second hinge plate.

17. The method of claim 16 further comprising:

attaching the first hinge plate to a first conductive member; and attaching the second hinge plate to a second conductive member.

18. The method of claim 17 further comprising pivoting the first conductive member relative to the second conductive member.

19. The method of claim 17, wherein the first conductive member is an electrical component housing box with an opening, and the second conductive member is a cover for at least partially occluding the opening of the electrical component housing box.

20. The method of claim 19 further comprising pivoting the cover relative to the electrical component housing box.

* * * * *